US006178412B1

(12) United States Patent
Ratzenberger, Jr. et al.

(10) Patent No.: US 6,178,412 B1
(45) Date of Patent: Jan. 23, 2001

(54) POSTAGE METERING SYSTEM HAVING SEPARABLE MODULES WITH MULTIPLE CURRENCY CAPABILITY AND SYNCHRONIZATION

(75) Inventors: Roger J. Ratzenberger, Jr., Milford; Joseph M Mozdzer, Beacon Falls; Wesley A. Kirschner, Hamden, all of CT (US)

(73) Assignee: Pitney Bowes Inc., Stamford, CT (US)

( * ) Notice: Under 35 U.S.C. 154(b), the term of this patent shall be extended for 0 days.

(21) Appl. No.: 09/294,605

(22) Filed: Apr. 19, 1999

(51) Int. Cl.[7] ..... G07B 17/00
(52) U.S. Cl. ..... 705/408; 705/410
(58) Field of Search ..... 705/400, 401, 705/408, 410

(56) References Cited

U.S. PATENT DOCUMENTS

| | | | | |
|---|---|---|---|---|
| 4,757,537 | * | 7/1988 | Edelmann et al. | 380/51 |
| 4,831,555 | * | 5/1989 | Sansone et al. | 358/1.14 |
| 4,858,138 | * | 8/1989 | Talmadge | 364/464.02 |
| 5,021,964 | * | 6/1991 | Stubbs | 705/407 |
| 5,024,282 | * | 6/1991 | Raikes et al. | 177/25.15 |
| 5,313,404 | * | 5/1994 | Wu | 700/227 |
| 5,688,056 | * | 11/1997 | Peyret | 400/61 |
| 5,742,932 | | 4/1998 | Levitsky | 705/410 |
| 5,799,290 | * | 8/1998 | Dolan et al. | 705/410 |
| 5,917,925 | * | 6/1999 | Moore | 381/101 |
| 5,960,418 | * | 9/1999 | Kelly et al. | 705/408 |
| 6,064,989 | * | 5/2000 | Cordery et al. | 705/50 |

FOREIGN PATENT DOCUMENTS

| | | | |
|---|---|---|---|
| 0462427 | * | 12/1991 | (EP) . |
| 0 493 948 B1 | | 12/1991 | (EP) . |

OTHER PUBLICATIONS

Trefgarne: "City: City impervious to the hype and the glory George Trefgarne reports preparations for Monday's trading in the euro"; Jan. 2, 1999, Daily Telegraph.*

"Sterling disappears from Royal Mail's stamp for Europe" Dec. 13, 1998 Sunday Times (United Kingdom).*

* cited by examiner

*Primary Examiner*—Edward R. Cosimano
(74) *Attorney, Agent, or Firm*—Angelo N. Chaclas; Michael E. Melton

(57) ABSTRACT

A postage metering system includes a postage meter and a user interface in communication with the postage meter. The user interface includes a micro controller and a memory. The memory has stored therein a plurality of image data files corresponding to different currencies. The postage meter includes a micro controller and a memory having stored therein an indicator of meter currency type. The user interface uses the indicator of meter currency type from the postage meter to select a particular one of the plurality of image data files for use in printing a postal indicia.

24 Claims, 6 Drawing Sheets

POSTAGE METERING SYSTEM HAVING SEPARABLE MODULES WITH MULTIPLE CURRENCY CAPABILITY AND SYNCHRONIZATION

CROSS REFERENCE TO RELATED APPLICATIONS

This application is related to the following concurrently filed copending U.S. patent applications: application No. 09/294,607 entitled POSTAGE METERING SYSTEM HAVING CURRENCY SYNCHRONIZATION (E-633) and application No. 09/294,604 entitled POSTAGE METERING SYSTEM HAVING CURRENCY COMPATIBILITY SECURITY FEATURE (E-854), the disclosures of which are specifically incorporated herein by reference.

FIELD OF THE INVENTION

This invention relates to value dispensing systems. More particularly, this invention is directed to flexible postage metering system that provides for the interchangeability of modules, protection against the loss of postal funds and/or ease of manufacture, distribution and service.

BACKGROUND OF THE INVENTION

One example of a value dispensing system is a postage metering system including an electronic postage meter and a printer for printing a postal indicia on an envelope or other mailpiece. Recent efforts have concentrated on removing the printer from being an integral part of the postage meter. Also, the postage meter is generally detachable from the postage metering system so that any number of postage meters may be operatively coupled with the printer.

Electronic postage meters for dispensing postage and accounting for the amount of postage used are well known in the art. The postage metering system supplies proof of the postage dispensed by printing a postal indicia which indicates the value of the postage on an envelope or the like. The typical postage meter stores accounting information concerning its usage in a variety of registers. In a pre-payment type of postage meter, such as those employed in the United States, an ascending register tracks the total amount of postage dispensed by the meter over its lifetime. That is, the ascending register is incremented by the amount of postage dispensed alter each transaction. A descending register tracks the amount of postage available for use. Thus, the descending register is decremented by the amount of postage dispensed after each transaction. When the descending register has been decremented to some value insufficient for dispensing postage, then the postage meter inhibits further printing of indicia until the descending register is resupplied with funds. In a post-payment type of postage meter such as those employed in France, the ascending register may be retained as described above while the descending register is eliminated or set to an extremely high value.

Generally, the postage meter communicates data necessary for printing a postal indicia to the printer over suitable communication lines, such as: a bus, data link, or the like. During this transfer, the data may be susceptible to interception, capture and analysis. If this occurs, then the data may be retransmitted at a later time back to the printer in an attempt to fool the printer into believing that it is communicating with a valid postage meter. If successful, the result would be a fraudulent postage indicia printed on a mailpiece without the postage meter accounting for the value of the postage indicia.

It is known to employ secret cryptographic keys in postage metering systems to prevent such fraudulent practices. This is accomplished by having the postage meter and the printer authenticate each other prior to any transfer of print data or printing taking place. One such system is described in U.S. patent application Ser. Co./No. 08/579,507, filed on Dec. 27, 1995, and entitled METHOD AND APPARATUS FOR SECURELY AUTHORIZING PERFORMANCE OF A FUNCTION IN A DISTRIBUTED SYSTEM SUCH AS A POSTAGE METER (E-476) and now issued as U.S. Pat. No. 5.799,290. Another such system is described in U.S. patent application Ser. Co./No. 08/864,929, filed on May 29, 1997, and entitled SYNCHRONIZATION OF CRYPTOGRAPHIC KEYS BETWEEN TWO MODULES OF A DISTRIBUTED SYSTEM (E-612). These types of mutual authentication systems help to ensure that the printer is being contacted by a valid postage meter and that the postage meter is in communication with a valid printer.

Once the postage meter and the printer have mutually authenticated each other, the exchange of print data may begin. A portion of the print data requires generation of a secure token in the postage meter. This token is printed within the postal indicia and is used by a postal authority to verify the integrity of the postal indicia. Generally, the token is an encrypted representation of the postal information contained within the postal indicia printed on the mailpiece. In this manner, the postal authority can read the postal information printed on the mailpiece and independently calculate a token for comparison purposes with the token printed on the mailpiece. In the alternative, the token on the mailpiece may be decrypted to derive the postal information that is anticipated to be printed on the mailpiece. Examples of such techniques are described in U.S. Pat. Nos. 4,831,555 and 4,757,537.

To expedite print data transfer from the postage meter to the printer, the postal indicia may be partitioned into fixed data (graphics) and variable data (date, postage amount, piece count, serial number, etc.). Generally, the fixed data does not change from postal indicia to postal indicia while the variable data may change from postal indicia to postal indicia. To save data transmission time, the fixed data may be previously stored at the printer while the variable data is generated by the postage meter. To print a complete postal indicia, the variable data is transmitted to the printer and then merged with the fixed data at the printer to produce the print data signals necessary to drive the printer.

Additionally, to remain competitive in a global marketplace, it is important to design and build postage metering systems that may be efficiently deployed where consumer demand exists. This means that postage metering systems must be adapted for use depending upon the local currency (US $, CAN $, UK £, F-Franc, D-mark, S-Franc, Lira, Yen, Euro, etc.). Therefore, it is desirable to have the flexibility of moving postage metering systems from country to country as needed. Generally, the design of the postal indicia is subject to approval and/or specification by the postal authority. As a result, although the fixed data may change from country to country, the fixed data typically remains uniform in a given country for each postage metering system once a format has been established in the given country.

Because postage meters store and dispense postage, it is important that they operate reliably. Otherwise, a user may experience a loss of postal funds (money) if the postage meter were to experience a malfunction. Therefore, postage meter manufacturers typically exercise great care to ensure the reliable operation of the postage meter.

As another consideration, interchangeability of components, such as using the same postage meter with a plurality of different printers or using a plurality of different postage meters with the same printer is desirable. For example, a mailer located near the boarder of two countries may have need to post mail in both countries. So as to avoid redundancy and expense, the mailer would not want to operate two metering systems. As another example, business office may contemplate placing the postage metering system without the postage meter in a generally accessible area and issuing postage meters to various individuals and/or departments. In this manner, anyone with a postage meter could utilize the postage metering system.

Therefore, there is a need for a cost effective postage metering system having an architecture that allows for the interchangeability of modules, protects against the loss of postal funds and facilitates efficient manufacture, distribution and service.

SUMMARY OF THE INVENTION

Accordingly, it is an object of the present invention to provide a postage metering system with improved security that substantially overcomes the problems associated with the prior art by protecting the integrity of the currency/postal indicia image association while allowing for the interchangeability of postage meters and printers.

In accomplishing these and other objects there is provided a postage metering system including a postage meter and a usHer interface in communication with the postage meter. The user interface includes a micro controller and a memory. The memory has stored therein a plurality of image data files corresponding to different currencies. The postage meter includes a micro controller and a memory having stored therein an indicator of meter currency type. The user interface uses the indicator of meter currency type from the postage meter to select a particular one of the plurality of image data files for use in printing a postal indicia.

In accomplishing these and other objects there is provided a method of operating a postage metering system and a method of manufacturing a postage metering system that are generally analogous to the summary provided above.

Therefore, it should now be apparent that the invention substantially achieves the objects and advantages discussed above. Additional objects and advantages of the invention will be set forth in the description that follows, and in part will be obvious from the description, or may be learned by practice of the invention. Moreover, the objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown through out the drawings, like reference numerals designate like or corresponding parts.

DETAILED DESCRIPTION OF THE PREFERRED EMBODIMENTS

Figure 1:
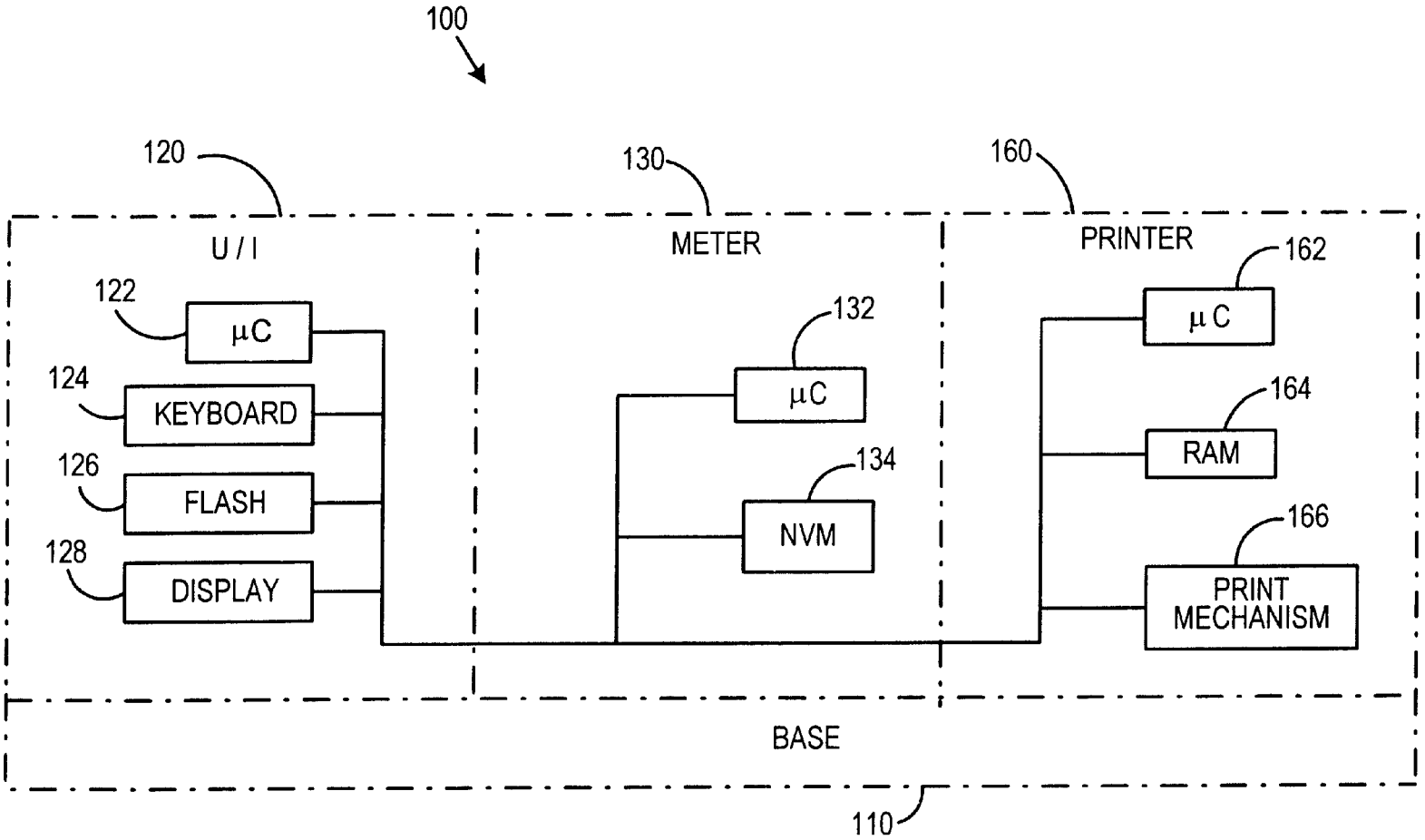
FIG. 1 is a schematic representation of a postage metering system including a base, a user interface, a postage meter and a printer in accordance with the present invention.

Referring to FIG. 1, a postage metering system 100 in accordance with the present invention is shown. The postage metering system 100 includes a mailing machine base 110, a user interface 120, a postage meter 130 and a printer 160.

The mailing machine base 110 includes a variety of different modules (not shown) where each module performs a different task on a mailpiece (not shown), such as: singulating (separating the mailpieces one at a time from a stack of mailpieces), weighing, moistening/sealing (wetting and closing the glued flap of an envelope) and transporting the mailpiece through the various modules. However, the exact configuration of each mailing machine base 110 is particular to the needs of the user. Since a detailed description of the mailing machine base 110 is not necessary for an understanding of the present invention, its description will be limited for the sake of clarity.

Generally, the user interface 120 is for displaying messages to and receiving commands from an operator of the postage metering system 100 and is detachably mounted to the base 110 using any conventional structure (not shown). The user interface 120 includes a micro controller 122, a keyboard 124, a non-volatile flash memory (flash) 126 and a display (CRT, LCD, LED, etc.) 128, all in operative communication with each other over suitable communication lines. The micro controller 122 may be of any suitable combination of processors, hardware, firmware and software. The flash 126 holds a plurality of indicia graphic data files for various postal indicia in protected memory. A more detailed description of an indicia graphic data file will be provided below.

The postage meter 130 may exist in a variety of configurations (smart card, secure housing containing an accounting circuit board, or the like) and is detachably mounted to the mailing machine base 110 by any conventional structure (not shown). In the most preferred embodiment, the postage meter 130 is a smart card type device, such as an ISO 7816 type IC card device, a PCMCIA (Personal Computer Memory Card International Association) card or other appropriate format device. The postage meter 130 determines a token (not shown) for each mailpiece so that the postal indicia may be verified by the postal authority. Further details of the token are provided below. The postage meter 130 includes a micro controller 132 and a non-volatile memory (NVM) 134 in operative communication with each other over suitable communication lines. The micro controller 132 may be of any suitable combination of processors, hardware, firmware and software while the NVM 134 is preferably an EEPROM. The NVM 134 holds various accounting information (not shown) and postal information (not shown), such as: an ascending register, a descending register, a control sum register, a piece count register and a postal identification serial number. Additionally, the NVM 134 holds currency type data (not shown) corresponding to a particular currency (US $, CAN $, UK £, F-Franc, D-mark, S-Franc, Lira, Yen, Euro, etc.). The currency type data will correspond to the monetary system used by the issuing postal authority.

The printer 160 may be detachably coupled to the mailing machine base 110 by any conventional structure (not shown) and includes a micro controller 162, a read access memory (RAM) 164 and a print mechanism 166 all in operative communication with each other over suitable communication lines. The RAM 164 stores the indicia graphic data that has been received from the user interface 120. The micro controller 162 supplies print signals to the print mechanism 166 to print a postal indicia (not shown) on a mailpiece (not shown). Generally, the print mechanism 166 may be of any suitable design employing dot matrix or digital printing technology, such as: thermal transfer, thermal direct, ink jet, wire impact, electrophotographic or the like.

To provide for security of postal funds and to prevent fraud, the postage meter 130 and the printer 160 are provided with secret cryptographic keys which are necessary for mutual authentication to ensure that: (i) the postage meter 130 will only transmit postal indicia print information to a valid printer 160; and (ii) the printer 160 will only execute postal indicia print information received from a valid postage meter 130. Generally, a mutual authentication routine involves the encryption and decryption of secret messages transmitted between the postage meter 130 and the printer 160. An example of such a routine can be found in U.S. patent application Ser. Co./No. 08/864,929, filed on May 29,1997, and entitled SYNCHRONIZATION OF CRYPTOGRAPHIC KEYS BETWEEN TWO MODULES OF A DISTRIBUTED SYSTEM, incorporated herein by reference. However, since the exact routine for mutual authentication is not necessary for an understanding of the present invention, no further description is necessary. Once mutual authentication is successful, the postage meter 130 is enabled to transmit postal indicia print information and the printer 160 is enabled to print a valid postal indicia.

Figure 2:
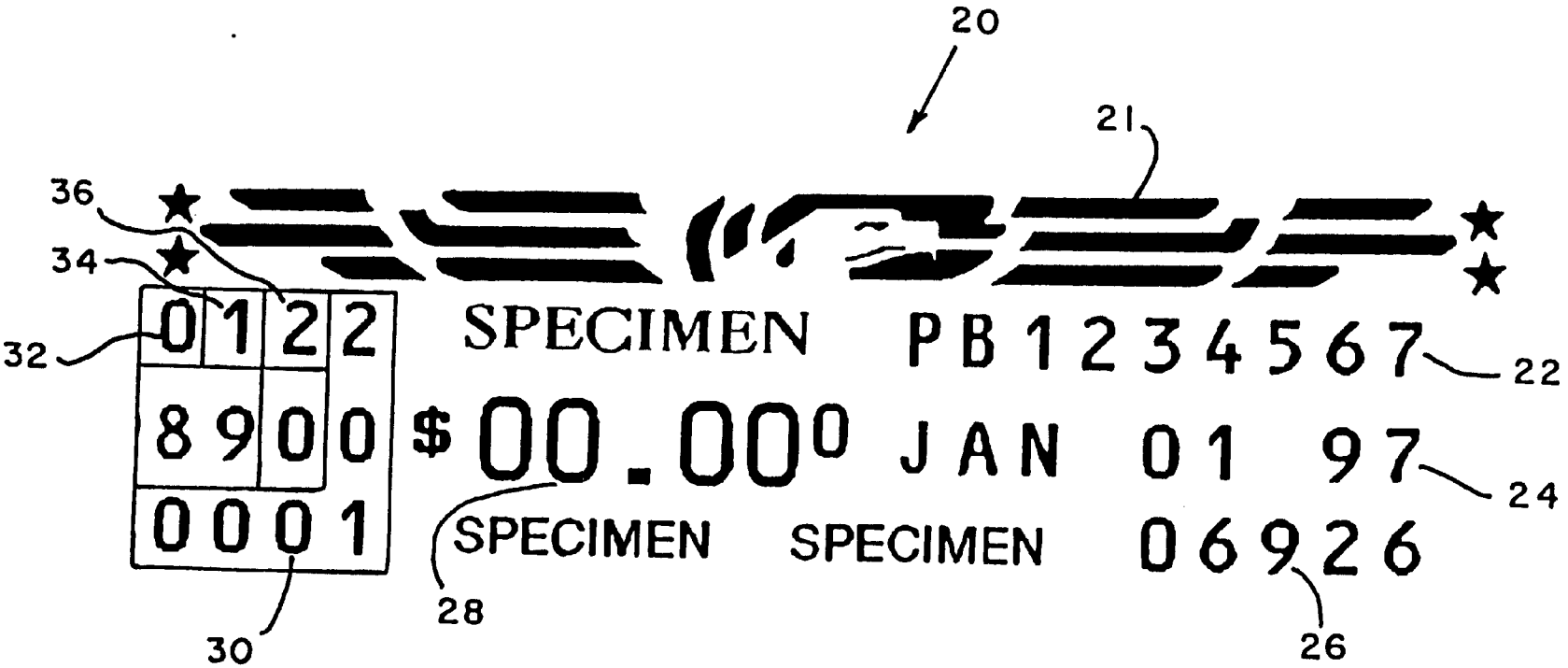
FIG. 2 is an example of a postal indicia that may be printed by the postage metering system of the present invention in a first country.

Referring to FIG. 2, an example of a postal indicia 20 that may be employed in the United States for example is shown. The postal indicia 20 includes both fixed data that does not change from postal indicia to postal indicia and variable data that may change from postal indicia to postal indicia. The fixed data includes a graphic design 21 (an eagle with stars), a meter serial number 22 uniquely identifying the postage meter 130 and a licensing post office ID (zip code) 26. The variable data includes a date 24 indicating when the postage was dispensed, a postal value 28 indicating an amount of postage, a piece count 30, a postage meter manufacturer ID 32, postage meter manufacturer verification data 34 and postal authority verification data 36. Using the data contained within the postal indicia 20, the postal authority can verify the authenticity of the postal indicia 20 using conventional techniques. Alternatively, the postal indicia 20 may only include a single token.

Generally, the graphic design 21 portion of the postal indicia 20 is unique for each country. However, this does not necessarily have to be true, but is dependent upon postal authority approval. Also, the variable data content may change from country to country.

Figure 3:
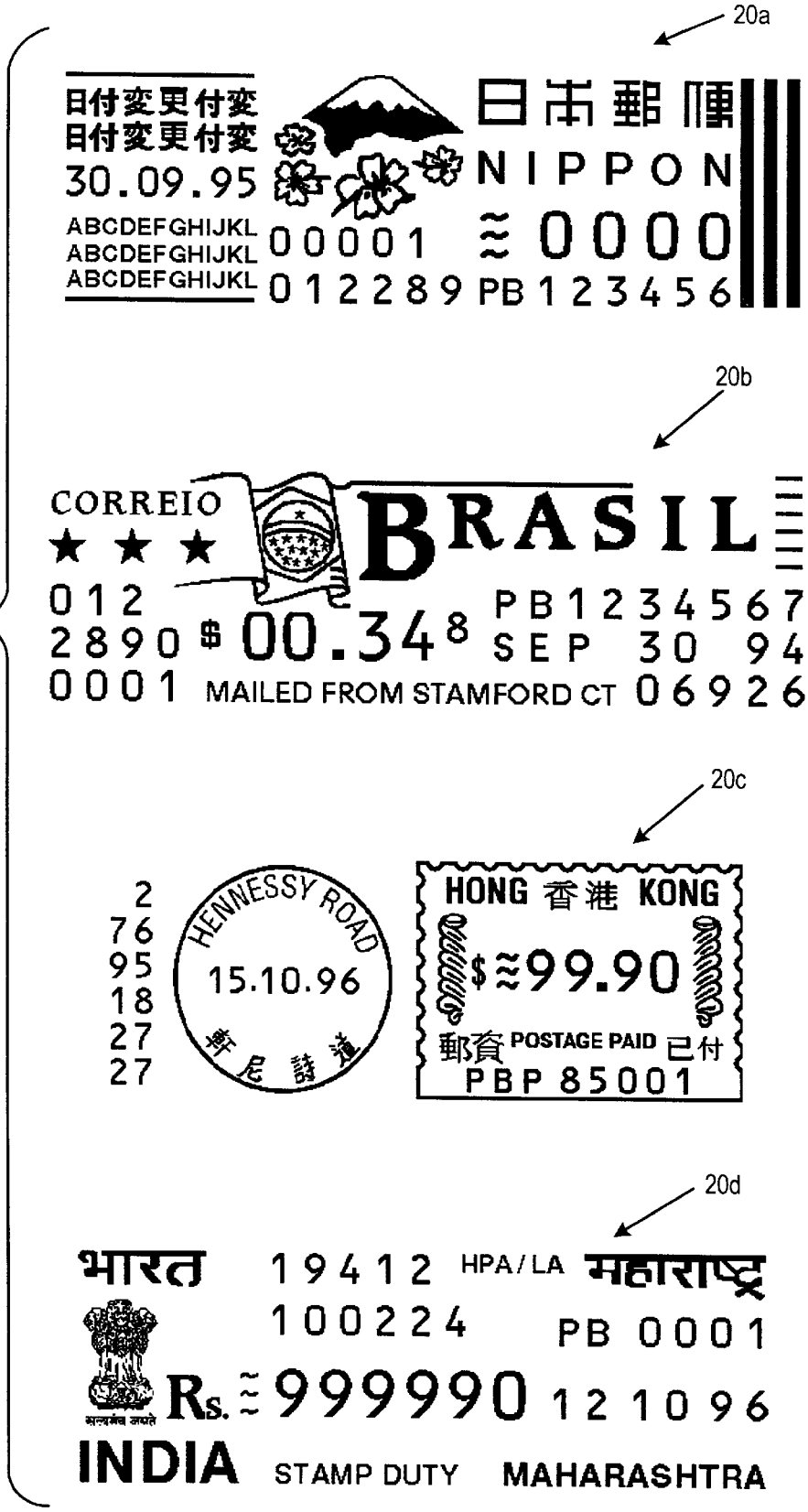
FIG. 3 is a sampling of a plurality of a postal indicia that may be printed by the postage metering system of the present invention in different countries.

Referring to FIG. 3, examples of a plurality of postal indicia 20*a*, 20*b*, 20*c* and 20*d* from a variety of countries are shown. The plurality of postal indicia 20*a*, 20*b*, 20*c* and 20*d* include both fixed and variable data as described above and are employed in Japan, Brazil, Hong Kong and India, respectively.

Figure 4:
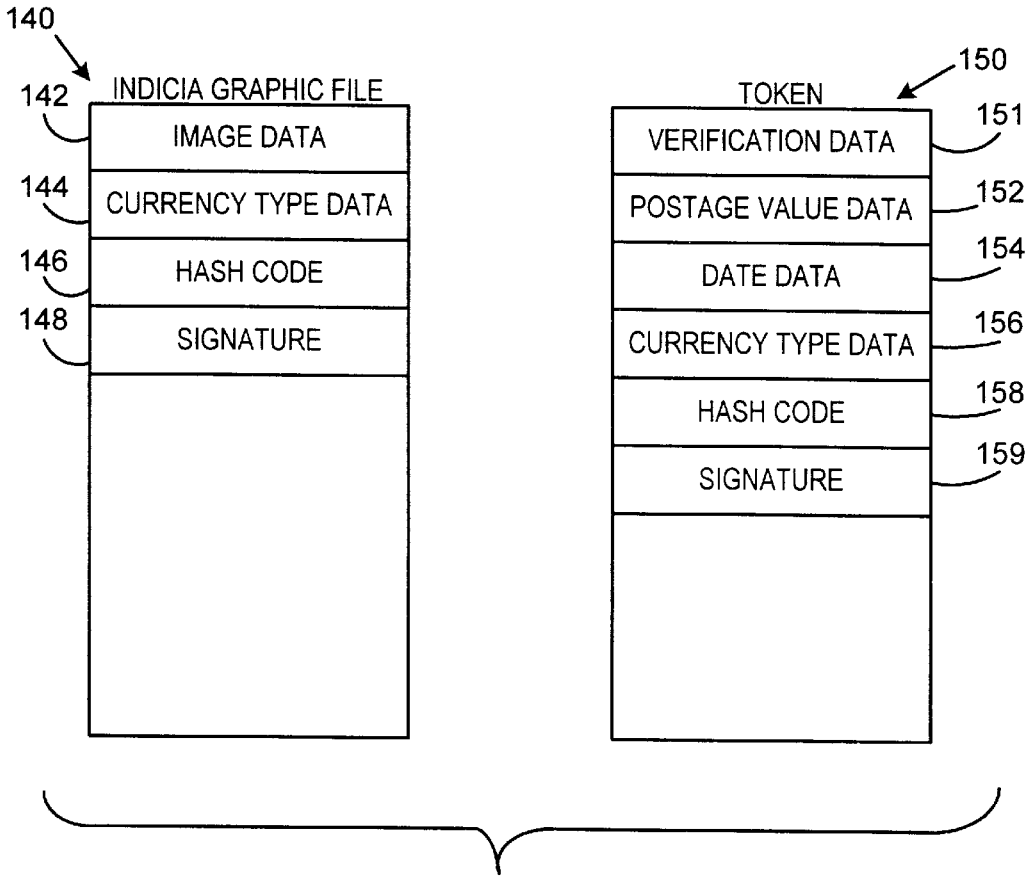
FIG. 4 includes schematic representations of indicia graphic data and a token in accordance with the present invention.

Referring to FIG. 4, in view of FIGS. 1, 2 and 3, schematic representation of an indicia graphic data file 140 and the token 150 are shown. A plurality of indicia graphic data files 140 are generated by the manufacturer and stored in the user interface flash 126 prior to distribution of the postage metering system 100. The indicia graphic data file 140 includes image data 142, currency type data 144, a hash code 146 and a digital signature 148. For the sake of this discussion, it is assumed that the indicia graphic data file 140 corresponds to the postal indicia 20 shown in FIG. 2. The image data 142 is representative of the postal indicia 20 and includes fixed graphic data corresponding to the fixed portion of the postal indicia 20 and format data indicating mapped regions or fields within the postal indicia 20 that define the insertion locations for the variable portion of the postal indicia 20. The currency type data 144 designates a particular currency (US $, CAN $, UK £, F-Franc, D-mark, S-Franc, Lira, Yen, Euro, etc.) corresponding to the image data 142. In this case, United States dollars. The hash code 146 is a value generated from the image data 142 and currency type data 144 using a predetermined hash function algorithm. Generally, hash codes are substantially smaller than the data strings that they are based on. Also, the hash function algorithm is designed in such a way that it is extremely unlikely that two data strings will produce the same hash code. Additionally, the algorithm is further designed so that it is nearly impossible to derive the original data string from the hash code. Any number of different conventional hash function algorithms may be employed to generate the hash code 146. The signature 148 is a value generated from the hash code 146 using a predetermined encryption technique (public key, private key, etc.). Generally, like a written signature, the purpose of a digital signature is to guarantee that the entity sending a message really is who it purports to be. To be effective, digital signatures must be unforgeable. Any number of different conventional encryption techniques may be employed to generate the signature 148. By acting on the hash code 146, the calculations to produce the signature 148 are simplified because the data string is smaller than the amount of data associated with the indicia graphic data file 140.

In the most preferred embodiment, the signature 148 is generated using a postal graphics key $K_{pg}$ according to the following equation:

$$\text{Signature}=\text{DES}(\text{Hash Code};\ K_{pc}) \tag{1}$$

where DES represents a Data Encryption Standard encryption engine, the hash code 146 represents the message to be encrypted and the key $K_{pg}$ represents the cryptographic key used to perform the encryption. For ease of implementation, the postal graphics key $K_{pg}$ may be universal for all postage metering systems 100. However, it is within the contemplation of this invention that other keys may be derived and utilized.

The remaining indicia graphic data files 140 correspond to postal indicia formatted for other countries, respectively. For example, they may correspond to those postal indicia 20*a*, 20*b*, 20*c* and 20*d* shown in FIG. 3. Those skilled in the art will recognize that the only limit to the number of indicia graphic data files 140 that may be stored is the size of the flash 126. In the most preferred embodiment, the world is divided into regions and only those indicia graphic data files 140 within a given region are stored in the flash 126. For example, Region 1 may be North America and include: the United States, Canada and Mexico; Region 2 may include the member states of the European Union; Region #3 may include all African countries; Region #4 may include all pacific rim countries; and so on. This would strike an appropriate compromise between size of memory required and the probability of which type of postage meters 130 the postage metering system 100 is likely to see given its location.

The token 150 is generated by the postage meter 130 in response to a request from the operator to print postage and is transmitted to the printer micro controller 162 for use in formatting the postal indicia 20. The token 150 includes verification data 151, postage value data 152, date data 154, currency type data 156, a hash code 158 and a digital signature 159. Generally, the verification data 151 is printed within the postal indicia 20 and is; used by the postal authority to verify the integrity of the postal indicia 20. The postage value data 152 corresponds to the postal value 28 by indicating the amount of postage requested while the date data 154 indicates the current date. The currency type data 156, the hash code 158 and the digital signature 159 are analogous to those discussed above with respect to the indicia graphic data file 140.

Figure 5:
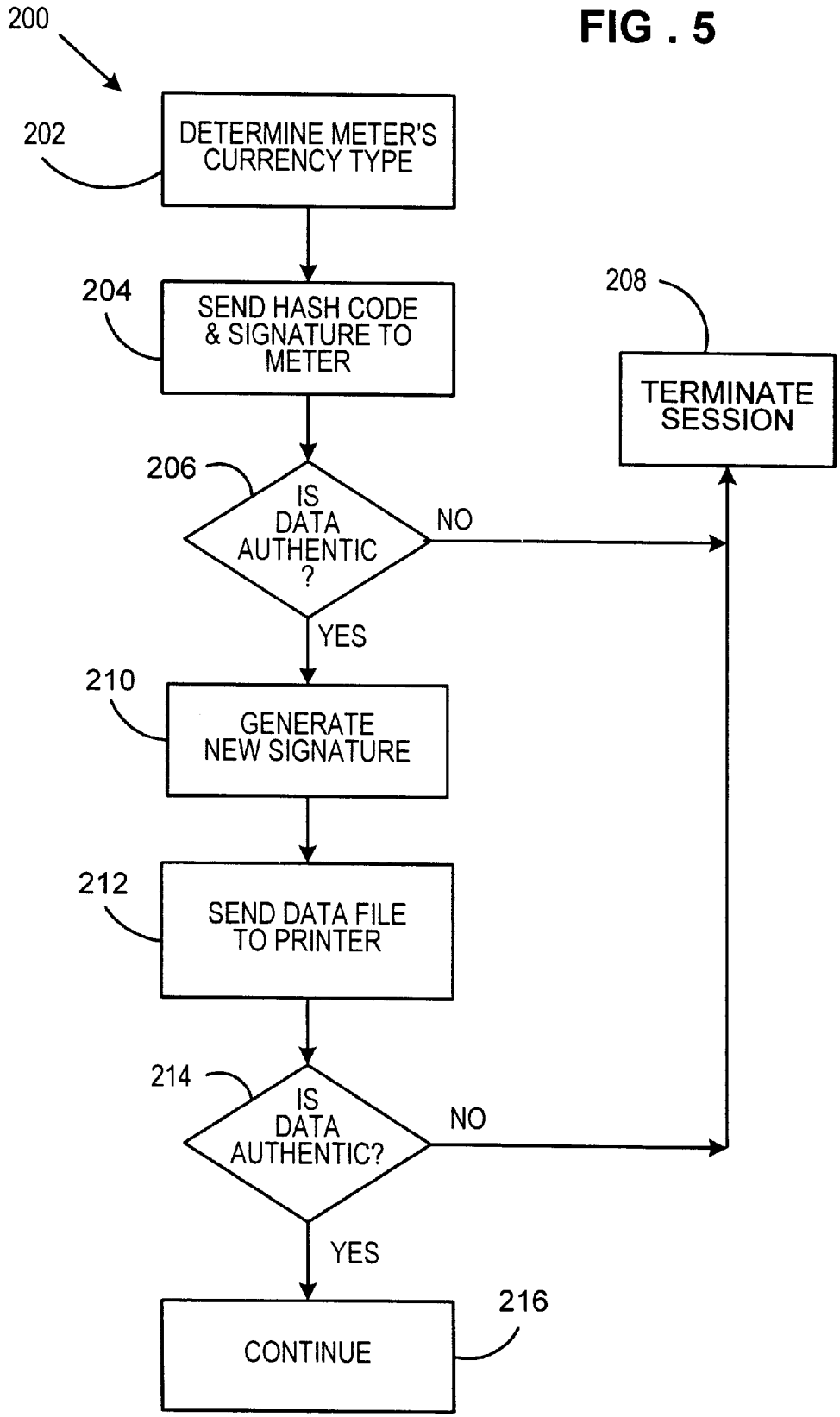
FIG. 5 is a flow chart of a routine for synchronizing a user interface with a postage meter in accordance with the present invention.

Referring to FIG. 5, in view of the structure of FIGS. 1–4, a routine 200 showing the operation of the postage metering system 100 following a successful system initialization is shown. As described above, during system initialization, the postage meter 130 and the printer 160 seek to mutually authenticate each other in response to a predetermined event, such as: system power up, the beginning of a batch run of mailpieces, after a predetermined number of mailpieces, any other desired event and/or any combination of the above. For the sake of clarity and brevity, it is assumed that mutual authentication has been successful, a session has been established where the postage meter is enabled to dispense postage and the printer is enabled to print postal indicia and the operator has requested the postage metering system 100 to print postage on a mailpiece.

At 202, the user interface 120 queries the postage meter 130 to determine the currency type of the postage meter 130 in response to a predetermined event. Preferably, the predetermined event is immediately after session initialization. However, the predetermined event may be any combination of convenient events, such as: the beginning of a batch run of mailpieces, after a predetermined number of mailpieces and/or any other desired event. In the most preferred embodiment, downloading of the indicia graphic data file 140 is tied to each session initialization. However, the two activities may occur independently. This is accomplished using the postage meter currency type data stored in NVM 134. Furthermore, the user interface 120 will configure its menu screens to correspond with the postage meter currency type data. Next, at 204, the user interface 120 retrieves from flash 126 the indicia graphic data file 140, corresponding to the currency type of the postage meter 130, and sends the hash code 146 and the digital signature 148 to the postage meter 130.

Next, at 206, the postage meter 130 makes a general determination of whether or not the indicia graphic data file 140 is authentic (from a trusted source, such as the postage metering system manufacturer or the postal authority) using an encryption technique corresponding to the one employed to generate the signature 148 and communicates the results to the user interface 120. More specifically, to achieve this the postage meter 130 generates its own signature using the hash code 146 and compares it to the signature 148 that was obtained from the user interface 120 to see if they match. If the answer is yes, then the routine 200 proceeds to 210. On the other hand, if the answer is no, then, at 208, the session is terminated. However, as an alternative to terminating the session, any activity that has as its effect the prevention of printing the postal indicia 20 may be employed.

At 210, the postage meter 130 generates a new signature of the hash code 146, according to the following equation:

$$\text{New Signature}=\text{DES}(\text{Hash Code};\ K_s) \qquad (2)$$

where DES represents the Data Encryption Standard encryption engine, the hash code 146 represents the message to be encrypted and the key $K_s$ represents a session key used to perform the encryption, and sends the new signature to the user interface 120. In the most preferred embodiment, the session key $K_s$ should be unique for each postage metering system 100 and should not be the same for any consecutive sessions; between the postage meter 130 and the printer 160. However, it is within the contemplation of this invention that other keys may be derived and utilized. Next, at 212, the user interface 120 sends a portion of the indicia graphic data file 140 (the image data 142 and the currency type data 144) and the new signature to the printer 160. The image data 142 is loaded into RAM 164 for subsequent use.

Next, at 214, the printer 160 makes a determination whether or not the portion of the graphic data file 140 is authentic (from a trusted source, such as the postage metering system manufacturer or the postal authority) using an encryption technique corresponding to the one employed to generate the new signature. That is, the printer 160 has already established the session key $K_s$ during session initialization with the meter 130. Thus, the printer 160 generates its own hash code from the image data 142 and currency type data 144 using the predetermined hash function algorithm and then generates its own new signature of its own hash code. If the received new signature and the generated new signature match, then the image data 142 and currency type data 144 are deemed authentic. If the answer at 214 is yes, then the routine 200 proceeds to 216 where the postage metering system 100 continues normal operation and awaits a request to print postage. On the other hand, if the answer is no, then, at 208, the contents of the RAM 164 are erased and the session is terminated. However, as an alternative to terminating the session and deleting the image data 142 from the RAM 164, any activity that has as its effect the prevention of printing the postal indicia 20 may be employed.

It should now be apparent that a first key ($K_{pg}$) is employed to verify the image data 142 and currency type data 144 are from a trusted source while a second key ($K_s$) is employed to verify that the image data 142 and currency type data 144 are downloaded to the printer 160 correctly.

Figure 6:
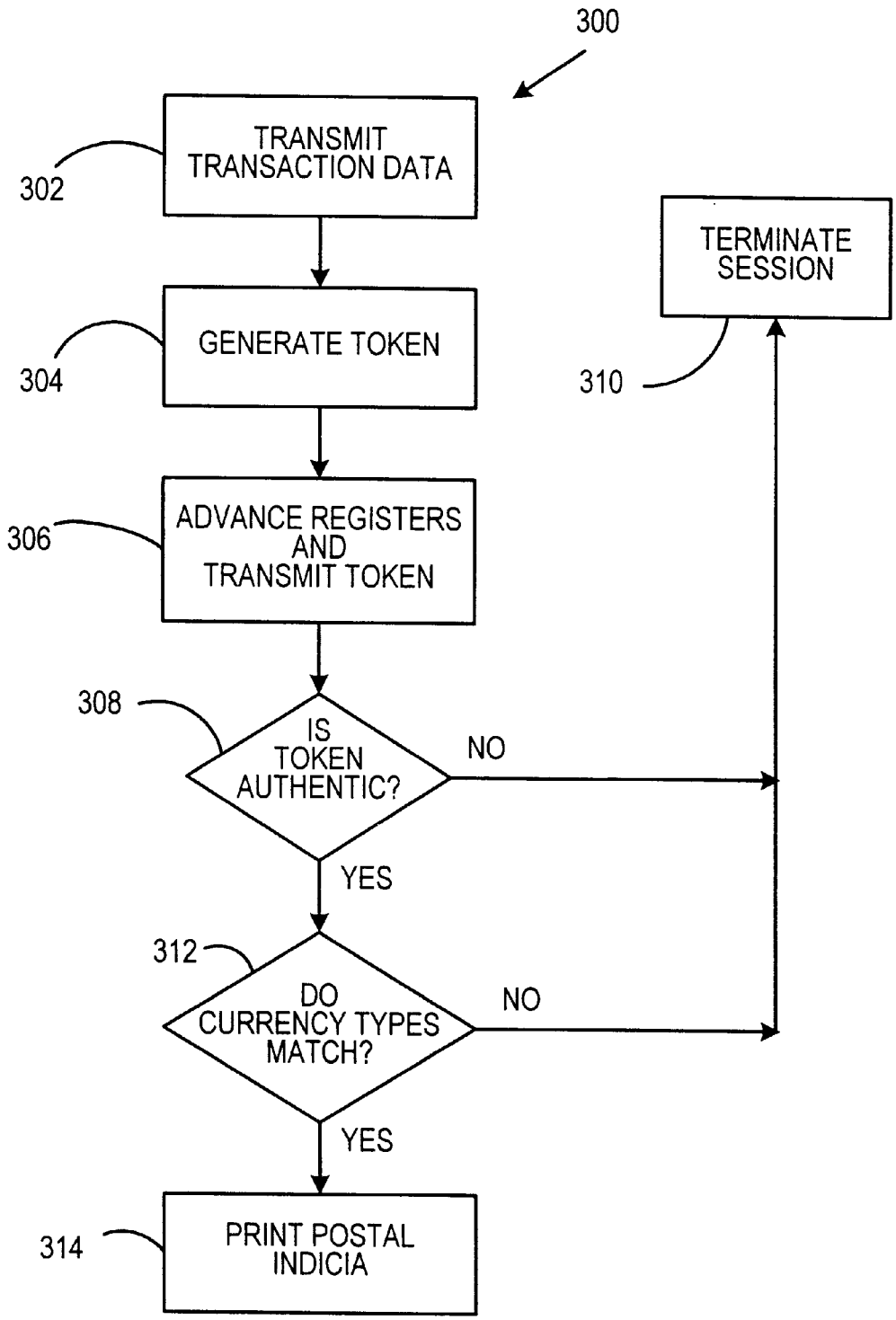
FIG. 6 is a flow chart of a routine for ensuring that the currency type of the token generated by the postage meter matches the currency type of the image graphic data in the printer in accordance with the present invention.

Referring to FIG. 6, in view of the structure of FIGS. 1–4, a routine 300 showing the operation of the postage metering system 100 in printing a postal indicia 20 is shown. The routine 300 is run in response to a request to print postage following successful system initialization and download of the image data 142 and currency type data 144 to the printer 160.

At 302, the user interface 120 transmits transaction data to the postage meter 130. Generally, the transaction data includes the postage value data 152 as requested by the operator either directly through the user interface 120 or by the base 110 and the date data 154. At 304, using the session key $K_s$, the postage meter 130 generates the token 150 by: (i) assembling the postage value data 152 and/or the date data 154 (as well as any other data, such as: piece count, serial number, etc., that may be defined as variable data); (ii)

generating the verification data 151; (iii) using its currency type data; and (iv) generating the hash code 158 (using the verification data 151, postage value data 152, date data 154 and currency type data 156) and the signature 159. Next, at 306, the postage meter 130 advances the registers accordingly in relation to the postage value data 152 and transmits the token 150 to the printer 160 via the user interface 120. Next, at 308, the printer 160 makes a determination whether or not the token 150 is authentic using an encryption technique corresponding to the one employed to generate the signature 159. If the answer is yes, then the routine 300 proceeds to 312. On the other hand, if the answer is no, then the routine proceeds to 310 where the session is terminated.

At 312, the printer 160 makes a determination whether or not the currency type data 144 contained within the indicia graphic data file 140 corresponds to the currency type data 156 contained within the token 150. Generally, this may be accomplished by: (i) using the same hash function algorithm in the same manner as was employed to generate the hash code 146 to verify the accuracy of the currency type data 144; (ii) using the same hash function algorithm in the same manner as was employed to generate the hash code 158 to verify the accuracy of the currency type data 156; and (iii) comparing the currency type data 144 with the currency type data 156 to see if they are the same. If the answer is yes, then the routine 300 proceeds to 314 where the postal indicia 20 is printed by the print mechanism 166. On the other hand, if the answer is no, then the routine proceeds to 310.

Those skilled in the art will now appreciate the present invention substantially addresses those objects and advantages presented earlier. For example, interchangeability of the user interface, postage meter and the printer is provided for by having these modules of the postage printing system automatically configure themselves following session initialization or some other predetermined event. Generally, the user interface and the printer adapt to correspond to the currency type of the postage meter. As a result, there is no need to manufacture or store country specific user interfaces or printers. Therefore, inventory control and distribution are simplified for the manufacturer.

As another example, the cost of the postage metering system is reduced. Because of miniaturization, smart card memory is very expensive in comparison with traditional memory. Therefore, the memory requirements of the smart card postage meter have been off loaded to the user interface. That is, the user interface has stored within its memory all of the graphic data files necessary to print postal indicia in various countries. Additionally, because the physical device of the postage meter represents a very small percentage of the overall postage metering system, it may incorporate robust design details that protect against the loss of postal funds due to malfunction without adversely affecting the overall cost of the postage metering system.

As yet another example, reliability and ease of service of the postage metering system are improved. Generally, it is anticipated that the postage meter would be the most reliable device in the overall postage metering system because it does not contain any moving parts subject to failure. On the other hand, keyboards and printers suffer from periodic failure. If such a failure occurs, then the defective module may be removed and replaced with ease without the need to dispatch a customer service representative or ship the entire postage metering system to the manufacturer. A replacement module may be delivered to the operator for installation and the defective module returned to the manufacturer in the same shipping container as was used for the replacement module.

As still another example, flexibility of use is improved. When the postage meter is a smart card, then cards may be issued to numerous individuals that may access the same postage metering system at some convenient location (company cafeteria, student center, airport, etc.) or distributed postage metering systems located at numerous locations. Once a user inserts the smart card postage meter, the postage metering system configures itself according to the currency of the postage meter. Thus, the postage metering system allows overlapping use of different currencies. Thus, the user interface will configure itself to the currency of the postage meter. Optionally, the user interface may also configure itself and/or the display by taking other appropriate action, such as: setting the number of decimal places in the postage value, setting maximum/minimum allowable postage values, setting the displayed currency symbol ($, £, F-Franc, DM, Euro, etc.) and/or selecting an appropriate language for the menu screens of the display.

Those skilled in the art will now also appreciate that the present invention allows the printer to adapt to the currency type of tire postage meter. Thus, at those locations having the need to print postage in two currencies, two postage meters may be employed with a single base and printer. A first meter may be employed to print postage in a first currency and a second meter may be employed to print postage in a second currency because the printer is configured accordingly by having the postage meter hold the image graphic data and download it to the printer following session initialization. In this manner, the cost associated with having the printer store a plurality of image graphic data files corresponding to different countries in order to handle different meters is avoided.

It should be understood that the present invention is applicable to other postage metering systems having different configurations. For example, the exact configuration of the data that constitutes the fixed graphic portion, variable portion, verification data and other parameters is subject to wide design choice and specification by the postal authorities and thus is not a limiting factor to the practice of the present invention.

Many features of the preferred embodiment represent design choices selected to best exploit the inventive concept as implemented in a postage metering system having a postage meter, base and a printer. However, those skilled in the art will recognize that the concepts of the present invention can be applied to other postage metering system configurations that do not include a base, such as where the postage meter is a stand alone unit in operative communication with a printer. That is, the present invention is applicable to any postage metering system where the postage metering portion is remotely located from the printing portion. In this context, remote may mean adjacent, but not colocated within the same secure structure, or physically spaced apart.

Additionally, although the description above applies a specific encryption technique to verifying the authenticity of the currency type indicators, those skilled in the art will recognize that other techniques may be employed to prevent manipulation of the currency type indicators. For example, the currency type indicators may be disguised by integrating them in a predetermined fashion into the data strings that they are associated with. In this manner, the currency type indicator in not readily discernable because it is disguised with the data string. As another example, the verification process described above takes place in the postage meter because the user interface has been designed to be a non-trusted module. However, those skilled in the art will recognize that all of the functionality described above may be relocated to other modules without undue design changes.

Therefore, the inventive concept in its broader aspects is not limited to the specific details of the preferred embodiment but is defined by the appended claims and their equivalents.

What is claimed is:

1. A postage metering system, comprising:

a user interface including a micro controller and a memory having stored therein a plurality of image data files corresponding to different currencies; and a postage meter in communication with the user interface and including a micro controller and a memory having stored therein an indicator of meter currency type; and wherein:

the user interface uses the indicator of meter currency type of the postage meter to select a particular one of the plurality of image data files for use in printing a postal indicia.

2. The postage metering system of claim 1, wherein:

the user interface includes a display; and the user interface configures the display in accordance with the indicator of meter currency type of the postage meter.

3. The postage metering system of claim 2, further comprising:

a base; and wherein:

the postage meter is a smart card device and is detachably mounted to the base; and the user interface is detachably mounted to the base.

4. The postage metering system of claim 1, further comprising:

a printer in communication with the user interface and including a micro controller, a memory and a print mechanism for printing the postal indicia on a mailpiece; and wherein:

the user interface stores the particular one of the plurality of image data files in the printer memory.

5. The postage metering system of claim 4, wherein:

the postage meter verifies the integrity of the particular one of the plurality of image data files prior to the particular one of the plurality of image data files being stored in the printer memory.

6. The postage metering system of claim 5, wherein:

the user interface includes a display; and the user interface configures the display in accordance with the indicator of meter currency type of the postage meter.

7. The postage metering system of claim 6, wherein:

the plurality of image data files are part of a plurality of indicia graphic data files, respectively;

each of the plurality of indicia graphic data files include an indicator of its respective indicia currency type, a user interface hash code based on the image data file and the indicator of the indicia currency type and a user interface signature generated from the user interface hash code; and the postage meter verifies the integrity of the particular one of the plurality of image data files by: (i) receiving the user interface hash code and the user interface signature from the user interface; (ii) generating a meter signature from the user interface hash code; and (iii) comparing the meter signature with the user interface signature to see if they match.

8. The postage metering system of claim 7, further comprising:

a base; and wherein:

the postage meter is a smart card device and is detachably mounted to the base; and the user interface is detachably mounted to the base.

9. A method of operating a postage metering system including a user interface and a postage meter in communication with the user interface, the method comprising the step(s) of:

retrieving from the postage meter an indicator of meter currency type;

using the indicator of meter currency type of the postage meter to select a particular one of a plurality of image data files stored in the user interface, the plurality of image data files corresponding to different currencies; and using the particular one of the plurality of image data files in printing a postal indicia.

10. The method of claim 9, wherein the user interface includes a display and further comprising the step(s) of:

configuring the display in accordance with the indicator of meter currency type of the postage meter.

11. The method claim 10, wherein the postage metering system further includes a base, the postage meter is a smart card device and is detachably mounted to the base and the user interface is detachably mounted to the base.

12. The method of claim 9, wherein the postage metering system further includes a printer in communication with the user interface and further comprising the step(s) of:

storing the particular one of the plurality of image data files in the printer.

13. The method of claim 12, further comprising the step(s) of:

verifying the integrity of the particular one of the plurality of image data files prior to the particular one of the plurality of image data files being stored in the printer.

14. The method of claim 13, wherein the user interface includes a display and further comprising the step(s) of:

configuring the display in accordance with the indicator of meter currency type of the postage meter.

15. The method of claim 14, wherein the plurality of image data files are part of a plurality of indicia graphic data files, respectively, and each of the plurality of indicia graphic data files include an indicator of its respective indicia currency type, a user interface hash code based on the image data file and the indicator of the indicia currency type and a user interface signature generated from the user interface hash code and further comprising the step(s) of:

verifying the integrity of the particular one of the plurality of image data files by: (i) retrieving the user interface hash code and the user interface signature from the user interface; (ii) generating a meter signature from the user interface hash code; and (iii) comparing the meter signature with the user interface signature to see if they match.

16. The method claim 15, wherein the postage metering system further includes a base, the postage meter is a smart card device and is detachably mounted to the base and the user interface is detachably mounted to the base.

17. A method of manufacturing a postage metering system including a user interface and a postage meter in communication with the user interface, the method comprising the step(s) of:

providing the postage meter with an indicator of meter currency type;

storing a plurality of a plurality of image data files stored in the user interface where the plurality of image data files correspond to different currencies;

programming the postage metering system to use the indicator of meter currency type of the postage meter to select a particular one of a plurality of image data files stored in the user interface; and programming the postage metering system to use the particular one of the plurality of image data files in printing a postal indicia.

18. The method of claim 17, further comprising the step(s) of:

providing the user interface with a display; and programming the postage metering system to configure the display in accordance with the indicator of meter currency type of the postage meter.

19. The method claim 5, further comprising the step(s) of:

providing the postage metering system with a base;

providing the postage meter as a smart card device detachably mounted to the base; and detachably mounting the user interface to the base.

20. The method of claim 17, further comprising the step(s) of:

providing the postage metering system with a printer; and programming the postage metering system to store the particular one of the plurality of image data files in the printer.

21. The method of claim 20, further comprising the step(s) of:

programming the postage metering system to verify the integrity of the particular one of the plurality of image data files prior to the particular one of the plurality of image data files being stored in the printer.

22. The method of claim 21, further comprising the step(s) of:

providing the user interface with a display; and programming the postage metering system to configure the display in accordance with the indicator of meter currency type of the postage meter.

23. The method of claim 22, further comprising the step(s) of:

storing the plurality of image data files as part of a plurality of indicia graphic data files, respectively, where each of the plurality of indicia graphic data files include an indicator of its respective indicia currency type, a user interface hash code based on the image data file and the indicator of the indicia currency type and a user interface signature generated from the user interface hash code; and programming the postage metering system to verify the integrity of the particular one of the plurality of image data files by: (i) retrieving the user interface hash code and the user interface signature from the user interface; (ii) generating a meter signature from the user interface hash code; and (iii) comparing the meter signature with the user interface signature to see if they match.

24. The method claim 23, further comprising the step(s) of:

providing the postage metering system with a base;

providing the postage meter as a smart card device detachably mounted to the base; and detachably mounting the user interface to the base.

* * * * *